United States Patent [19]

Yamamoto et al.

[11] 3,948,198

[45] Apr. 6, 1976

[54] LOW TEMPERATURE LIQUEFIED GAS TANKER SHIP

[75] Inventors: Katsuro Yamamoto, Tokyo; Toru Sato, Kamakura; Kenzi Ogino, Odawara, all of Japan

[73] Assignee: Bridgestone Liquefied Gas Company, Ltd., Tokyo, Japan

[22] Filed: Feb. 14, 1975

[21] Appl. No.: 549,923

[30] Foreign Application Priority Data

Feb. 16, 1974 Japan ..... 49-18691

[52] U.S. Cl. ..... 114/74 A; 62/55; 220/9 LG

[51] Int. Cl.[2] ..... B63B 25/16

[58] Field of Search..... 114/74 R, 74 A; 62/45, 62/55; 220/9 LG, 9 F, 15

[56] References Cited

UNITED STATES PATENTS

| | | | |
|---|---|---|---|
| 2,782,956 | 2/1957 | Richman | 114/74 A |
| 2,991,906 | 7/1961 | Eligoulachuili | 114/74 R |
| 3,267,685 | 8/1966 | Schroeder | 220/9 LG |
| 3,312,076 | 4/1967 | Clarke et al. | 62/45 |
| 3,339,779 | 9/1967 | Horton et al. | 220/9 LG |
| 3,347,402 | 10/1967 | Forman et al. | 114/74 A |
| 3,692,205 | 9/1972 | Cowles et al. | 114/74 A |

*Primary Examiner*—Trygve M. Blix
*Assistant Examiner*—Charles E. Frankfort
*Attorney, Agent, or Firm*—Stewart and Kolasch

[57] ABSTRACT

A wall structure of a low temperature liquefied gas tanker ship of a type which comprises a hull structure, a compression resistant heat insulating layer and an inner membraneous vessel, characterized by a dish-like secondary barrier wall which covers only a lower portion of the inner membraneous vessel, an upper edge portion of the dish-like secondary barrier wall being bent outwardly to form a flange-like portion which traverses the heat insulating layer and is fluid-tightly connected to the hull structure.

7 Claims, 2 Drawing Figures

LOW TEMPERATURE LIQUEFIED GAS TANKER SHIP

BACKGROUND OF THE INVENTION

1. Field of the Invention

This invention relates to a tanker ship for carrying low temperature liquefied gases such as liquefied natural gas and, more particularly, an improvement regarding the structure of a secondary barrier wall which temporarily prevents leakage of liquefied gases which may occur at an inner membraneous vessel of a low temperature liquefied gas tank incorporated in the tanker ship.

2. Description of the Prior Art

Generally, in a tanker ship for carrying liquefied gases of a relatively moderate cold temperature such as, for example, down to minus 50° centigrade, a hull of the ship itself can serve as the aforementioned secondary barrier wall. However, in a tanker ship which carries liquefied gases of much lower temperatures, an independent secondary barrier wall other than the hull is required. In this case, if the secondary barrier wall is provided to cover the entire body of the inner vessel, it requires a substantial amount of material and manufacturing causing, as a result, a substantial increase in the construction cost of a tanker ship.

In view of the above drawback, it has been proposed to provide a secondary barrier wall which covers only bottom and lower portions of side walls of an inner membraneous vessel from the outside thereof, said secondary barrier wall being extended over a corresponding inner surface portion of a heat insulating layer provided between an outer shell or hull and the inner membraneous vessel. However, this structure is bound with a drawback that air tightness of the secondary barrier wall becomes very difficult to test.

SUMMARY OF THE INVENTION

Therefore, it is the object of this invention to solve the aforementioned problems and to provide an improved structure of the secondary barrier wall.

According to this invention, the abovementioned object is accomplished in a tanker ship for carrying low temperature liquefied gases, comprising a hull structure, a compression resistant heat insulating layer provided inside said hull structure and an inner membraneous vessel provided inside said heat insulating layer, by a secondary barrier wall which covers a bottom portion and at least a lower side wall portion of said inner membraneous vessel, said secondary barrier wall having an outwardly bent flange-like upper edge portion which traverses said heat insulating layer and is fluid-tightly connected to said hull structure.

In the abovementioned structure, since the secondary barrier wall does not cover the inner vessel up to the top thereof, its structure is simplified and the material/manufacturing can be spared. Furthermore, since a space which is confined by the hull and the secondary barrier wall and includes a lower portion of the heat insulating layer is constituted fluid-tightly, testing of the fluid-tightness of the secondary barrier wall can be easily accomplished by extracting gas from said space.

In order to test the fluid-tightness of the secondary barrier wall in the abovementioned manner, a tanker ship according to this invention may preferably comprise means for detecting leakage at the secondary barrier wall, said means including a gas extracting tube which opens toward a space confined by the hull and said secondary barrier wall. In this connection, it is favourable that said gas extracting tube is selectively opened toward a second space which is confined by said hull and said inner membraneous vessel, said second space being separated from the first-mentioned space which is confined by the hull and said secondary barrier wall.

By this arrangement, the fluid-tightness of the secondary barrier wall can be tested at any required time by opening a first valve provided in the gas extracting tube so as to extract the gas residing in said first space toward a proper gas analysing means, while closing a second valve which selectively opens said gas extracting tube towards said second space. In normal operating conditions, however, said first valve may preferably be closed while opening said second valve, whereby said first space which is confined by the hull and the secondary barrier wall and includes a lower portion of the heat insulating layer, and said second space which is confined by the hull and the inner vessel and includes an upper portion of the heat insulating layer, are fluidly communicated to each other, making it easy to control the pressure of an inert gas which is generally filled in these spaces.

BRIEF DESCRIPTION OF THE DRAWING

In the accompanying drawing.

DESCRIPTION OF THE PREFERRED EMBODIMENT

In the following, this invention will be described in more detail of a preferred embodiment with reference to the accompanying drawing.

Figure 1:
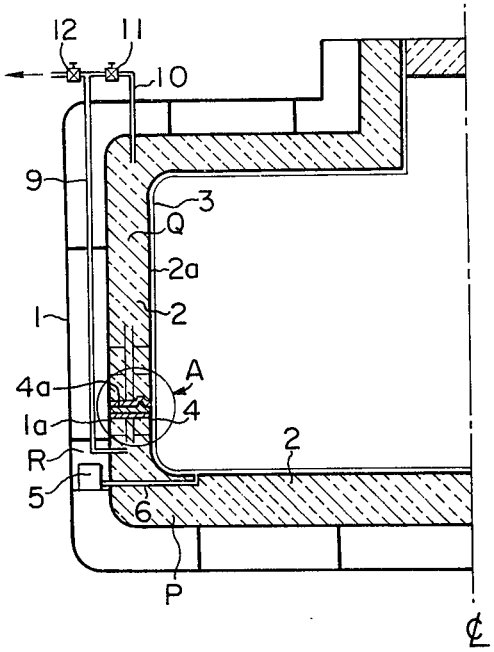
FIG. 1 is a cross sectional view of a part of a low temperature liquefied gas tanker ship as an embodiment of this invention, and, FIG. 2 is a sectional view which shows part A in FIG. 1 on an enlarged scale.
Figure 2:
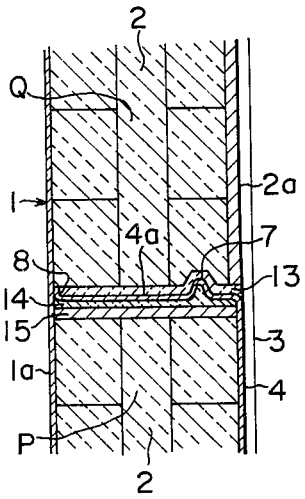

Referring to FIGS. 1 and 2, reference numeral 1 designates a hull, particularly a dual-walled hull, of a tanker ship. At the inside of the hull, a heat insulating layer 2 of a compression resistant structure is provided, and further at the inside of the heat insulating layer, an inner vessel 3 of a low temperature resistant membraneous structure is provided.

The heat insulating layer 2 may be made of a material which itself has compression resistant characterics, such as hard polyurethane foam, or it may be of a composite structure which comprises a wooden frame, the inside space of which is filled with granular pearlite, glass wool, etc., providing compression resistant characteristics as a whole.

In an inside surface layer of the heat insulating layer 2, i.e. over an inner surface or at a portion located a little inside of the inner surface of the heat insulating layer 2, a secondary barrier wall 4 is provided.

The secondary barrier wall 4 is formed like a dish which covers only a lower portion of the inner vessel 3 and has an upper edge portion 4a which is bent outwardly like a flange which traverses the heat insulating layer 2 and is fluid-tightly welded to the hull 1 at its peripheral edge portion.

An inner surface portion 2a of the heat insulating layer 2 located above the upper edge portion 4a of the secondary barrier wall may preferably be applied with a surface treatment which provides a relatively good impermeability to the inner surface portion.

A suction port of a pump or an ejector 5 is connected to a bottom portion of the secondary barrier wall 4 by means of a suction pipe 6, whereby liquid which has been collected in the space formed between bottom portions of the inner vessel 3 and the secondary barrier wall 4 is exhausted by the pump or ejector 5.

The upper edge portion 4*a* of the secondary barrier wall is formed with a curved portion 7 which allows for expansion or contraction of the secondary barrier wall. However, when the secondary barrier wall 4 is formed of a material which does not substantially expand or contract according to temperature change, such as invar, the curved portion 7 may be omitted.

An outer peripheral edge 8 of the upper edge portion 4*a* is bent upwardly to allow for better corner welding with the hull 1, and to give flexibility at the connecting portion of the inner hull 1*a* and the portion 4*a* of the secondary barrier wall. Furthermore, relatively thin layers 13 and 14 of polyurethane foam or glass wool are provided immediately above and below the upper edge portion 4*a* of the secondary barrier wall to allow for relatively free expansion or contraction of said portion 4*a*. A layer 15 of plywood or the like may be provided below the layer 14 to give a relatively flat surface to support said layer. When the layer 15 is provided, the layer 14 may be omitted.

The upper edge portion 4*a* may be formed of a same plate which forms a body of the vessel-like secondary barrier wall by bending a part of an integral plate. Alternatively, the upper edge portion 4*a* may be formed of a band member which is welded to an upper edge of a side wall portion of a vessel-like body at right angle thereto.

Thus, the heat insulating space provided between the hull 1 and the inner vessel 3 is divided by the upper edge portion 4*a* of the secondary barrier wall into two sections, i.e. lower section P and upper section Q.

A tube 9 to test fluid-tightness of the secondary barrier wall is connected to the lower section P while a tube 10 is connected to the upper section Q, both tubes 9 and 10 being connected to each other by way of a valve 11.

In the low temperature liquefied gas tanker ship according to this invention, if leakage of low temperature liquefied gases has occured due to a crack or a pinhole formed in the inner vessel 3, the fluid which has leaked out is collected by the dish-like secondary barrier wall 4.

Since the secondary barrier wall 4 is made of a low temperature resisting material, there occurs no problem even when the secondary barrier wall comes into direct contact with low temperature liquefied gases. Especially, when the secondary barrier wall is made of invar, it does not substantially contract when it has been subjected to very low temperature of the liquefied gases.

Since the liquid which has leaked out and been collected in the secondary barrier wall 4 is immediately exhausted by the pump or ejector 5 by way of the extracting tube 6, no damage is caused at the heat insulating layer 2.

A leakage detecting device may be provided in the space formed at the outside of the bottom of the inner vessel 3, whereby the pump or rejector 5 can be automatically operated when leakage has occured at the inner vessel 3.

When the fluid-tightness of the secondary barrier wall 4 is to be tested, the valve 11 is closed so as to isolate the lower section P from the upper section Q, while a valve 12 is opened to allow for a vacuum pump (not shown) to draw the gas contained in the lower section P, said gas being generally an inert gas such as nitrogen. If the pressure in the lower section P rises after it has once been lowered by the vacuum pump, leakage at the secondary barrier wall 4 is suspected.

Of course the pressure in the lower section P will also rise if leakage has occured at an inner hull 1*a* of the hull 1, the inner hull 1*a* can be approached by an inspector from an outside space R for closer inspection.

In normal operating conditions, the valve 12 is closed, while the valve 11 is opened to connect the lower section P fluidly with the upper section Q, whereby the pressure of the gas filled in the sections P and Q is balanced.

From the foregoing, it will be appreciated that in the low temperature liquefied gas tanker ship according to this invention, the secondary barrier wall 4 is effectively provided to cover only a portion of the inner vessel 3, whereby the structure of the secondary barrier wall is extremely simplified while sufficiently maintaining the safety against tank leakage as well as allowing for an efficient remote testing of fluid-tightness of the secondary barrier wall which is difficult to be approached by an inspector.

We claim:

1. A tanker ship for carrying low temperature liquefied gases, comprising a hull structure, a compression resistant heat insulating layer provided inside said hull structure, and an inner membraneous vessel provided inside said heat insulating layer, characterized by a secondary barrier wall which covers a bottom portion and at least a lower side wall portion of said inner membraneous vessel, said secondary barrier wall having an outwardly bent flange-like upper edge portion which traverses said heat insulating layer and is fluid-tightly connected to said hull structure.

2. A tanker ship according to claim 1, further comprising means for detecting leakage of said secondary barrier wall, said means including a gas extracting tube which opens toward a space confined by said hull structure and said secondary barrier wall.

3. A tanker ship according to claim 2, wherein said gas extracting tube is selectively opened toward a second space confined by said hull structure and said inner membraneous vessel, said second space being separated from the first-mentioned space confined by said hull structure and said secondary barrier wall.

4. A tanker ship according to claim 1, wherein said flange-like upper edge portion of the secondary barrier wall includes a corrugated portion to allow for expansion or contraction thereof.

5. A tanker ship according to claim 1, wherein an outer edge portion of said flange-like upper edge portion of the secondary barrier wall is bent substantially at right angle to a main portion of said flange-like portion.

6. A tanker ship according to claim 1, wherein said flange-like upper edge portion of the secondary barrier wall is bound with a relatively soft layer for easier expansion or contraction thereof.

7. A tanker ship according to claim 1, wherein said flange-like upper edge portion of the secondary barrier wall is supported by a smooth plate member for easier expansion or contraction thereof.

* * * * *